United States Patent [19]

Chen

[11] Patent Number: 4,556,394

[45] Date of Patent: Dec. 3, 1985

[54] TOY BUILDING BLOCK SET

[76] Inventor: Chen-Tsung Chen, No. 16, Alley 2, La. 7, Feng-Tung Rd., Fengyuan City, Taichung Hsien, Taiwan

[21] Appl. No.: 636,374

[22] Filed: Jul. 31, 1984

[51] Int. Cl.[4] ..... A63H 33/08

[52] U.S. Cl. ..... 446/124; 446/114; 446/116

[58] Field of Search ..... 446/124, 127, 114, 115, 446/116, 120, 125, 85, 108, 220

[56] References Cited

U.S. PATENT DOCUMENTS 2,776,521 1/1957 Zimmerman ..... 446/124 X 2,786,301 3/1957 Torricelli ..... 446/124 X

FOREIGN PATENT DOCUMENTS 1470898 4/1977 United Kingdom ..... 446/125

*Primary Examiner*—Mickey Yu

*Attorney, Agent, or Firm*—Knobbe, Martens, Olson & Bear

[57] ABSTRACT

A toy building block set having several kinds of blocks, each of them including a frame having a rectilinear outline, the connecting elements and sockets are formed along the periphery of the frame. The block sets are capable of being developed into a variety of articles through connecting selective blocks at selected relative positions, and assembling with an inflatable member to enable the finished work to float on the surface of the water.

7 Claims, 14 Drawing Figures

TOY BUILDING BLOCK SET

BACKGROUND OF THE INVENTION

This invention relates to plastic toy building blocks and particularly concerns a set of building blocks which can be connected with similar blocks in more than one direction, and the finished house or other article can float on the surface of the water.

There are many types of known building blocks, however, most of them have protrusions on one face and receiving cavities on the other face. By interengaging the protrusions of one block with the cavities of another block a desired shape can be developed. The connection amongst the elements could be effected only in a certain direction, therefore, in assembling there are few alternative positions.

Another disadvantage of the prior art is that the completed article can not be buoyed on the water surface. This tends to reduce interest while playing with the toy blocks.

SUMMARY OF THE INVENTION

With the above disadvantages in view, it is a general object of this invention to provide a set of toy building blocks constructed in such a manner that they can be adapted to connect with adjoining blocks in an edgewise intersecting, horizontal or perpendicular relationship.

It is another object of this invention to provide a set of toy building blocks which can be assembled into articles capable of being buoyed on the water surface.

In brief, this invention discloses a toy building block adapted to be assembled to develop a shape which comprises: a frame with rectilinear sides, having a plurality of connecting elements projecting from at least one side thereof, each of the connecting elements having a generally rectilinear cross-sectional outline and a slotted upper end; and a plurality of sockets provided on another side for receiving the connecting elements of a horizontally or vertically adjoining block respectively. The sockets on each block have an inversely complementary portion of the slotted upper end, a section is provided between two of the sockets, and a space is provided between two of the connecting elements and dimensioned to snap-fit the section of an edgewise intersectionally adjoining block.

According to a further feature of this invention, the molded frame comprises a geometrical member with or without an inscribed circular member.

Another important feature of this invention resides in an inflatable member suitable for passing through the circular members of adjacently connected blocks and inflatable to tightly engage with the circular member to make the finished work buoyant on the water surface.

The invention itself, together with additional objects and advantages thereof, will be best understood from the following description of specific embodiment when read in connection with the accompanying drawings, in which the like numerals indicate the same members.

DETAILED DESCRIPTION OF THE PREFERRED EMBODIMENTS

Figure 1:
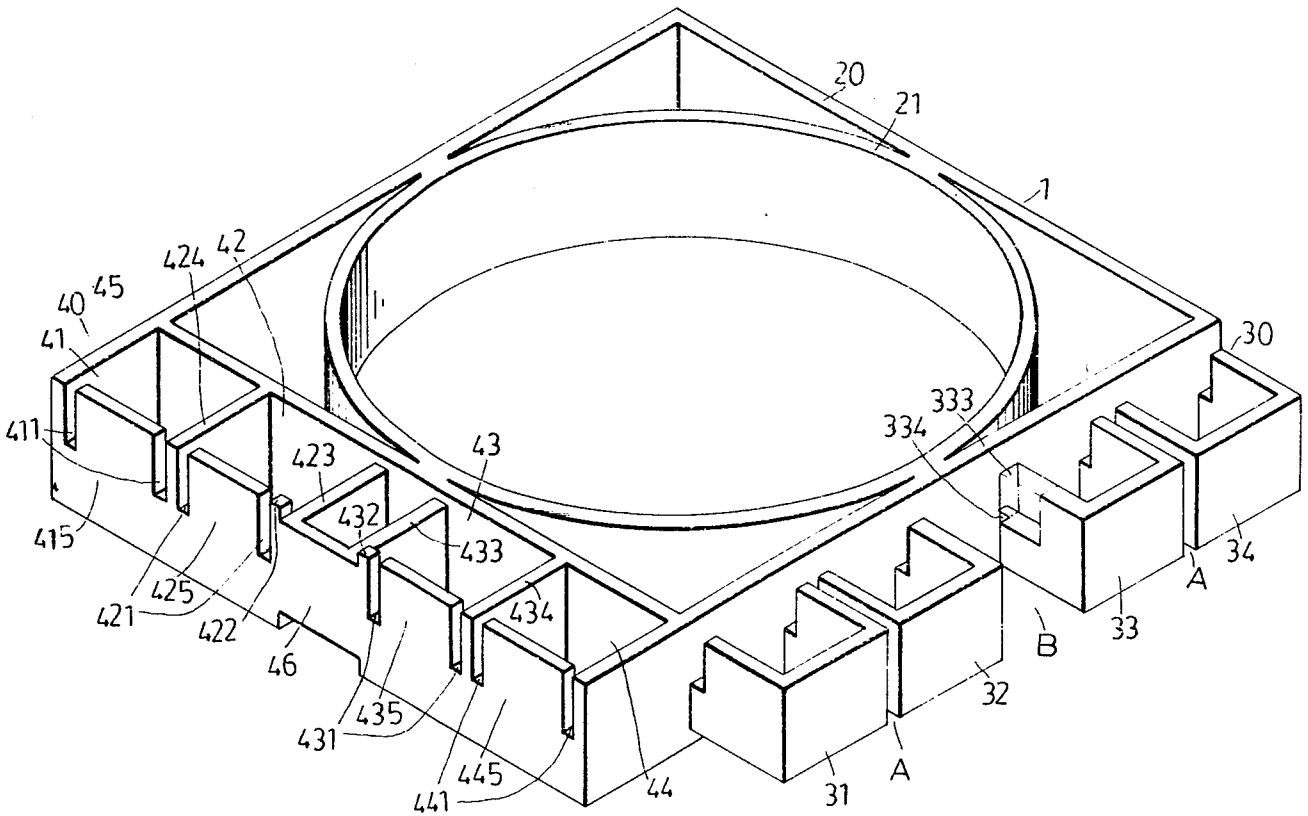
FIG. 1 is a perspective view of the first building block design according to an embodiment this invention.
Figure 2:
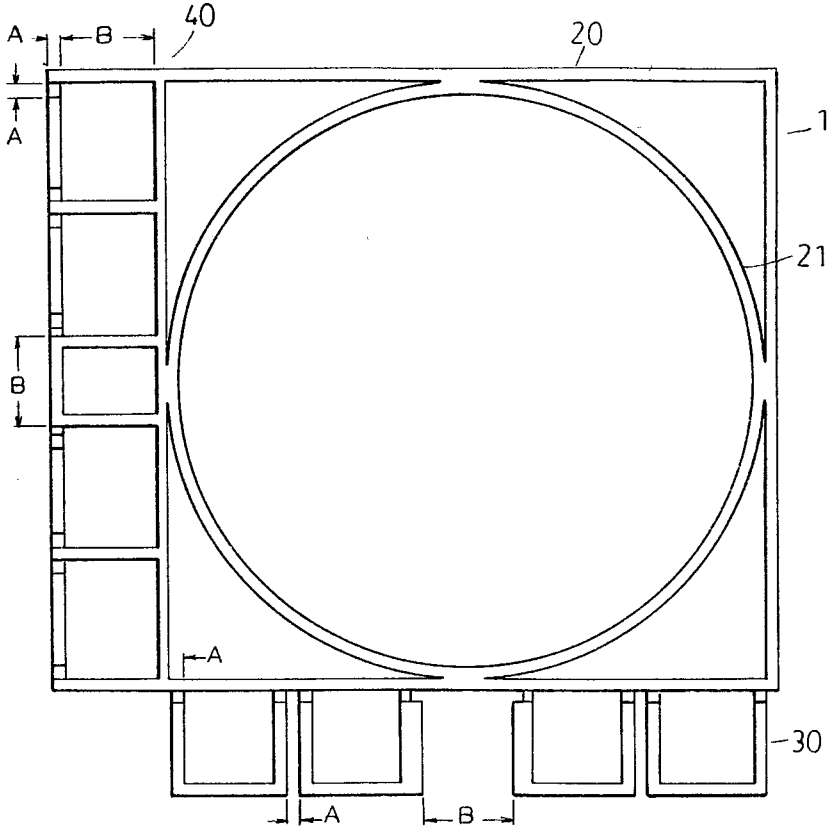
FIG. 2 is a schematic view of the first building block design illustrating the relationship of the dimensions of the portions of the building block as shown in FIG. 1.

Referring now to FIG. 1, the first block, generally denoted by numeral 1, is shown therein, in an illustrative manner. As can be seen, the first block 1 comprises a rectangular frame 20 having an inscribed circular portion 21. Along two adjacent sides there are connecting elements 30 and socket elements 40. The connecting elements 30 are projecting from one side and the connecting elements 30 are divided into two groups or halves, each half being spaced apart with a spacing "B", and each element of the halves are spaced from each other with a spacing "A", corresponding to the thickness of the wall thereof, as can be more clearly seen in FIG. 2.

Along the edges of the connecting element 30 contiguous to the rectangular frame 20, half depth slits 333 are provided.

Furthermore, the dotted lines showing a transparent portion for the benifit of illustration, each unslitted lower portion of the sides of the connecting elements 30 adjacent to the spacing "B" is provided with a half thickness slit 334.

Figure 10:
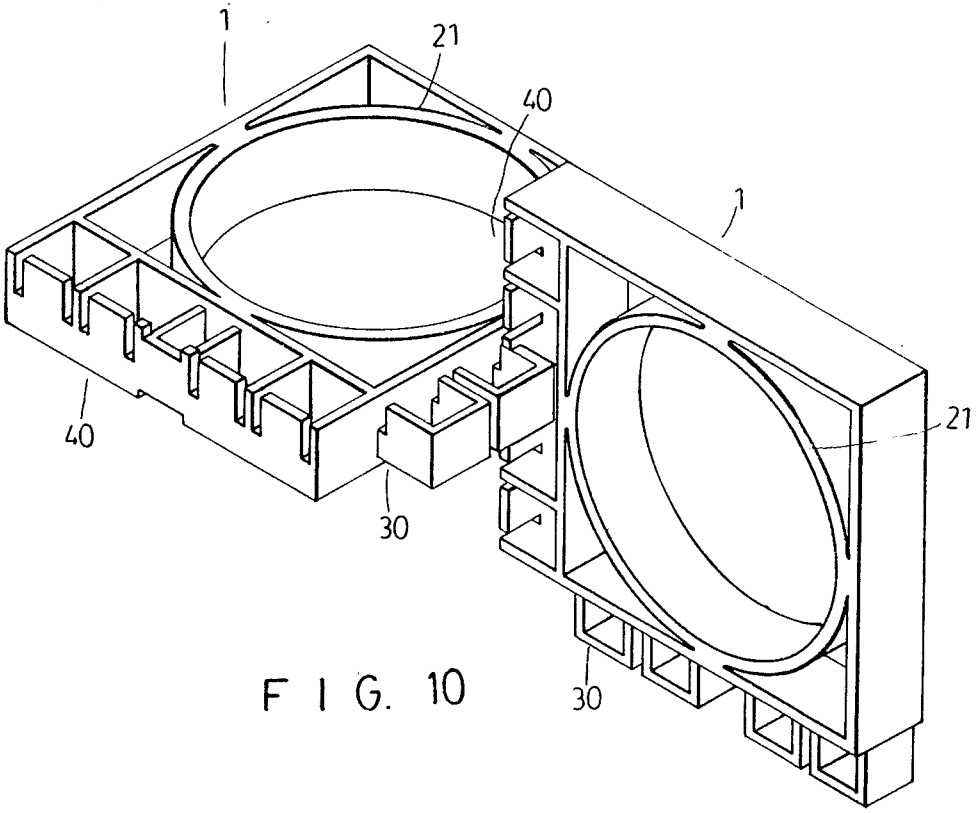
FIG. 10 is a view of the first block design connected in intersecting position with an adjoining block.

On the side adjacent to the side provided with connecting elements 30, a corresponding number of sockets 41, 42, 43, and 44 are provided, each socket is defined by a front wall, a rear wall and a pair of side walls. To effect a just fit of the sockets and the connecting elements in perpendicular, edgewise intersecting and horizontal relative positions, the left side wall 433 of the second socket 43 and the right side wall 423 of the third socket 42 define a rectangular section 46 cooperatively with the front wall and rear wall. The height and length of the rectangular section is equal to the spacing "B" between the halves of the connecting elements 30, therefore, two adjoining blocks can be connected on their intersecting sides as can be seen in FIG. 10.

Alternatively, the rectangular section defined by the side walls 423, 433 and front wall can also be made as a solid block, which is capable of fitting into the spacing "B" with the width thereof.

The inner dimension of every socket is made correspondingly to the outer dimension of the corresponding connecting element.

Each of the front walls of the sockets 41, 42, 43, 44 are formed with a pair of slits, denoted as 411, 421, 431 and 441 respectively, the slits are located on the edge adjacent to each side wall of the sockets 41, 42, 43, 44 respectively, extending through half the height of the socket. Adjacent to the left slit 431 of the third socket 43 and the right slit 421 of the second socket 42, there are protrusions 432, 422 respectively protruding over the front walls of the two sockets. When two adjoining blocks are connected on their intersecting sides as seen in FIG. 10, the protrusions 432, 422 can restrict the two blocks from moving off the connection.

Figure 9:
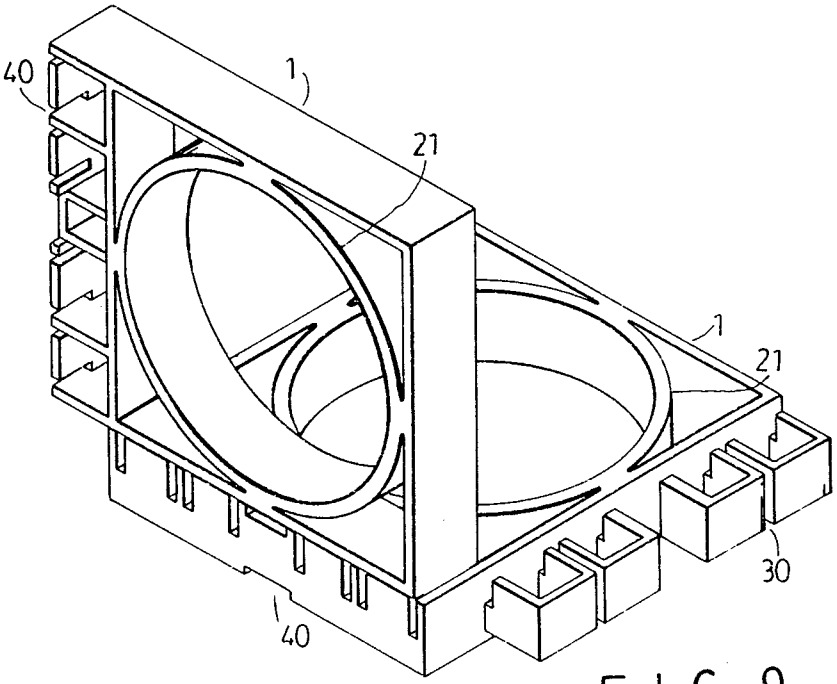
FIG. 9 is a view of the first block design connected in a perpendicular position with an adjoining first block design.

Referring to FIG. 9, two vertically adjoining blocks can be connected in such a way that inserting the connecting elements 31, 32, 33, 34 of a block into the corresponding sockets 41, 42, 43, 44 respectively, in this position, the spacing "B" can receive the rectangular section 46, and the side walls 434, 424 are fitted in the spacing "A" of the connecting elements.

Figure 11:
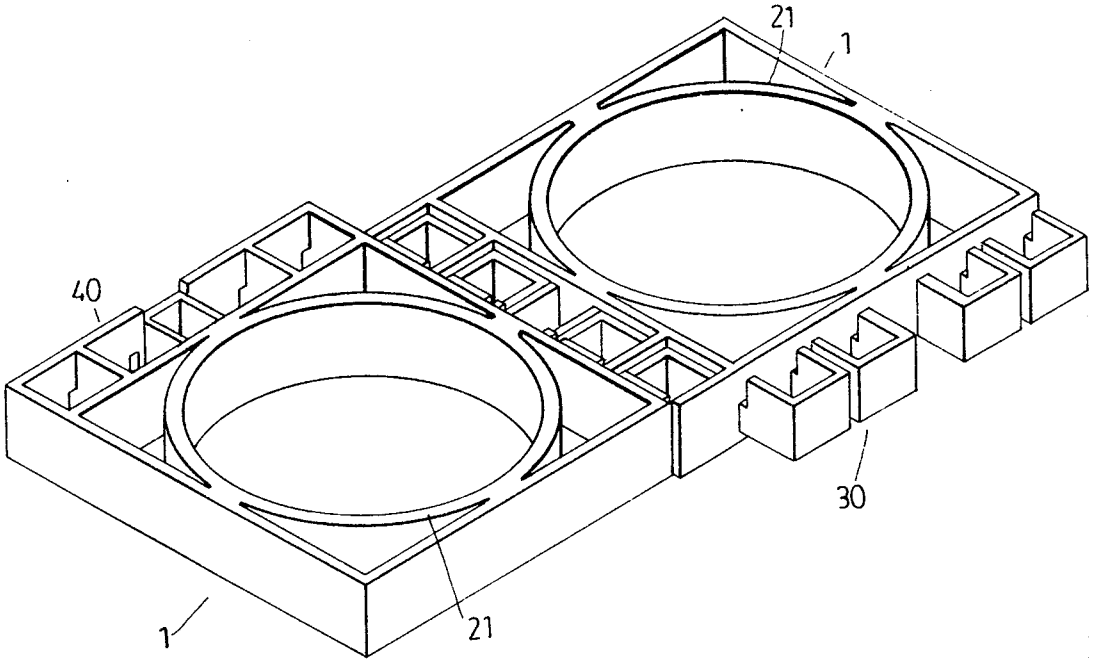
FIG. 11 is a view of a block connected in horizontal position with an adjoining first block design.

FIG. 11 shows two blocks in a horizontally connected position. When connecting the two, one block should be turned upside-down with respect to the other to place the connecting elements 31, 32, 33, 34 of the inverted block in the sockets 41, 42, 43, 44 of the horizontally adjoining block respectively. In such a position, the front walls 415, 425, 435, 445 having a thickness "A" are received in the half depth slit 333, with the slits 411, 421, 431, 441 interlocked with the unslitted lower portions of the connecting elements 31, 32, 33, 34 and substantially levelling the two blocks. It can be comprehended from the illustration that the protrusions 422, 432 are accomodated in the half thickness slit 334.

Figure 3:
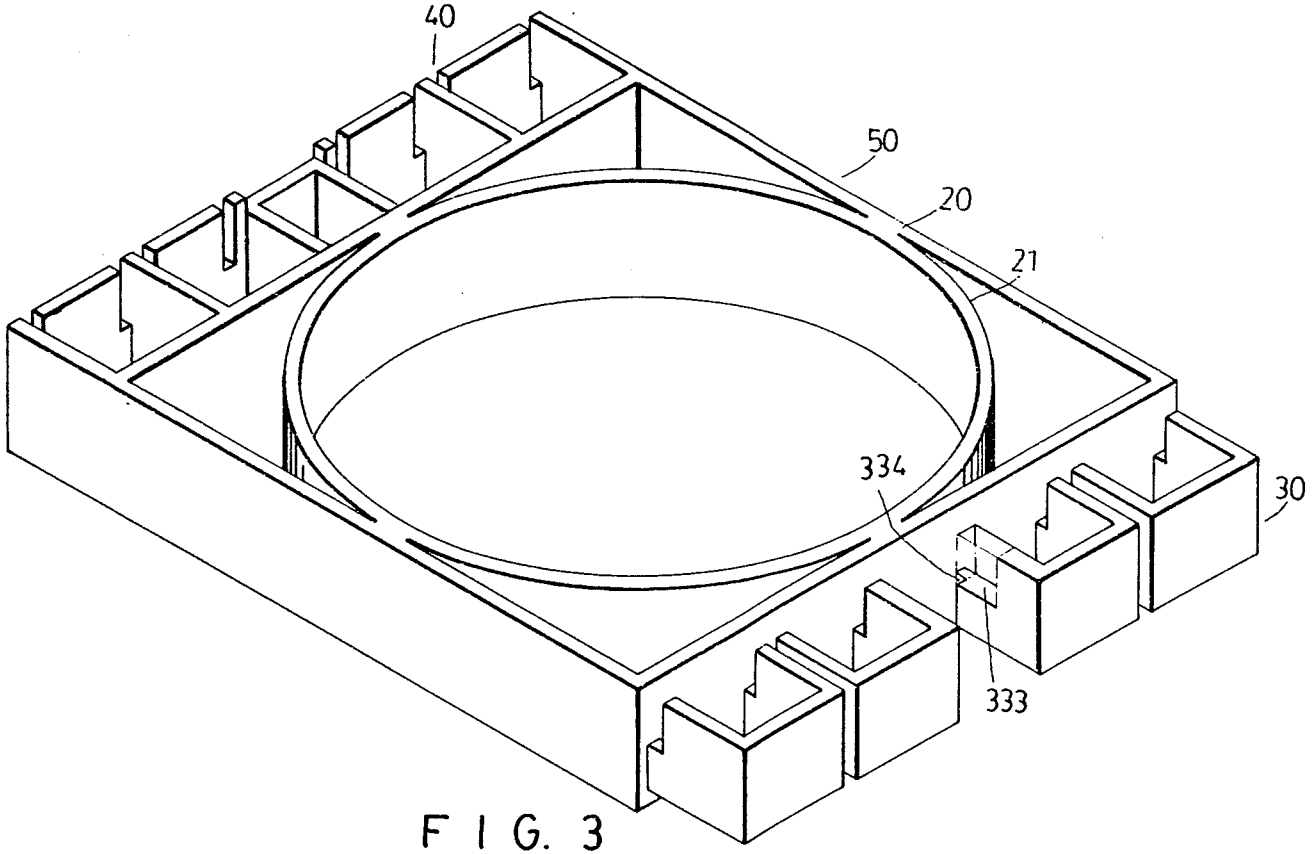
FIG. 3 is a perspective view of the second building block design according to an embodiment of this invention.
Figure 4:
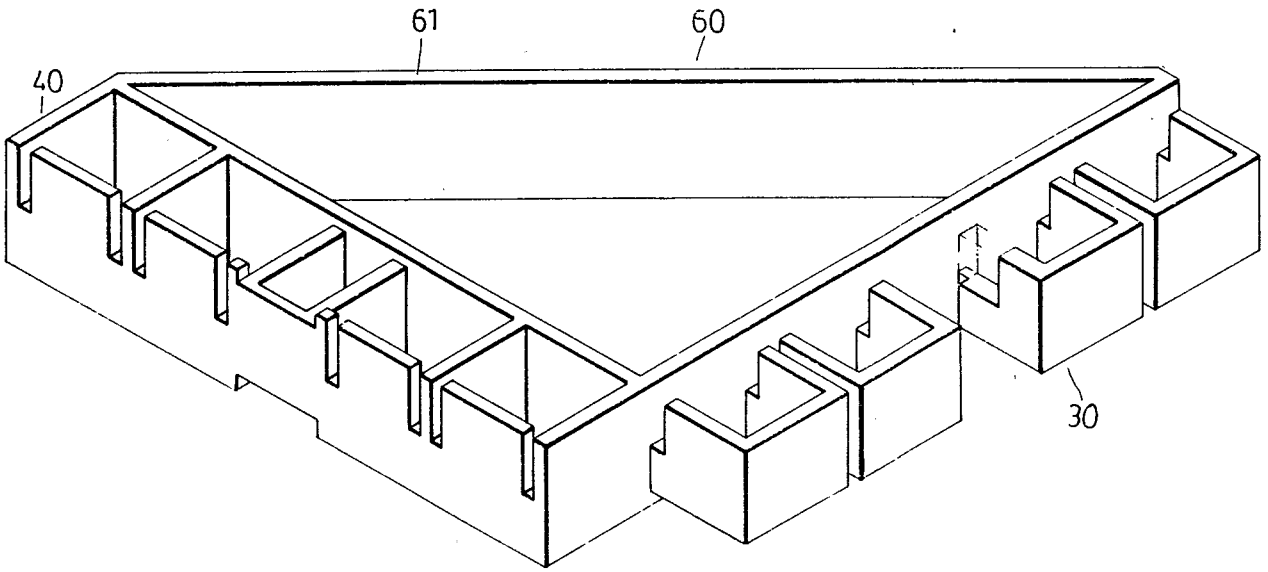
FIG. 4 is a perspective view of the third building block design according to an embodiment of this invention.

Another two kinds of blocks are respectively shown in FIG. 3 and FIG. 4. The block 50 shown in the former drawing includes the connecting elements 30 and the sockets 40 provided on opposite sides rather than adjacent sides. In the latter drawing, the block 60 is fabricated with a right-triangular frame 61 without the inscribed circular member, having the connecting elements 30 and the sockets 40 on adjacent sides, the other features of the elements are similar to that of the first block 1 described hereinbefore.

Figure 5:
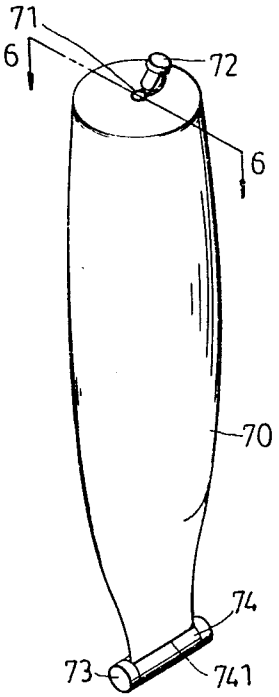
FIG. 5 is a perspective view of the first inflatable member design of the toy building set according to this invention.

Please refer to FIGS. 5 to 8 herein, where shown are the preferred embodiments of the inflatable member for assembling with the blocks and causing them float on the surface of the water. Referring through to FIG. 5, the inflatable tube 70 is made of plastic film with a thin thickness, at one end thereof there are provided with an inflating hole 71 and a removable stopper 72, the opposite end thereof is secured on a rolling shaft 73 passing through a slit 741 formed on a sleeve 74 mounted exterior of the shaft 73 and relatively rotatable therewith. The length of the column 70 can be adjusted by rolling one end thereof around the shaft 73 and releasing the rolled-up portion, the material being rolled around the shaft is accomodated within the spacing between the shaft 73 and the sleeve 74.

Figure 6:
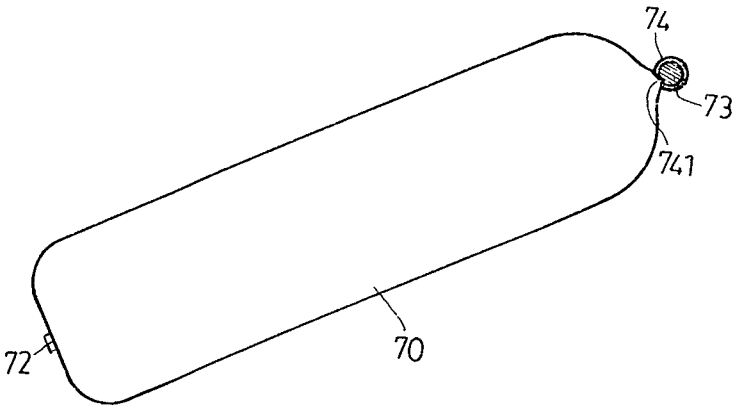
FIG. 6 is a longitudinal section view taken on lines 6—6 of FIG. 5.
Figure 7:
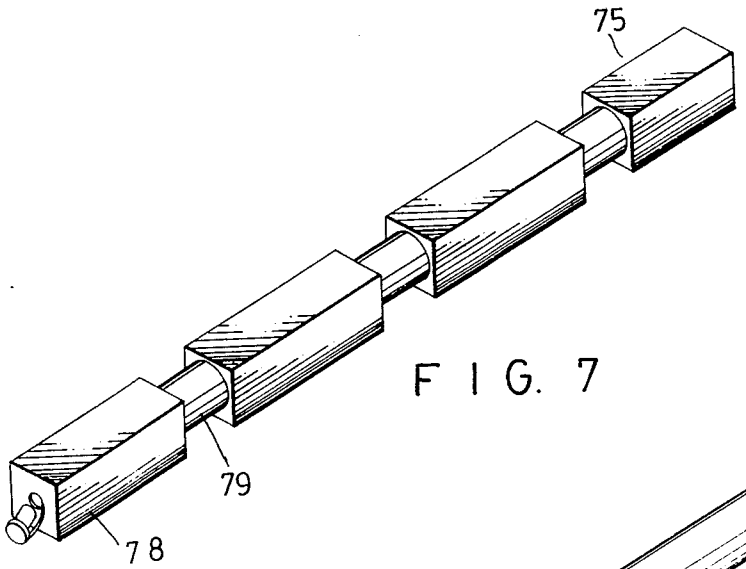
FIG. 7 is a perspective view of the second inflatable member design according to this invention.
Figure 8:
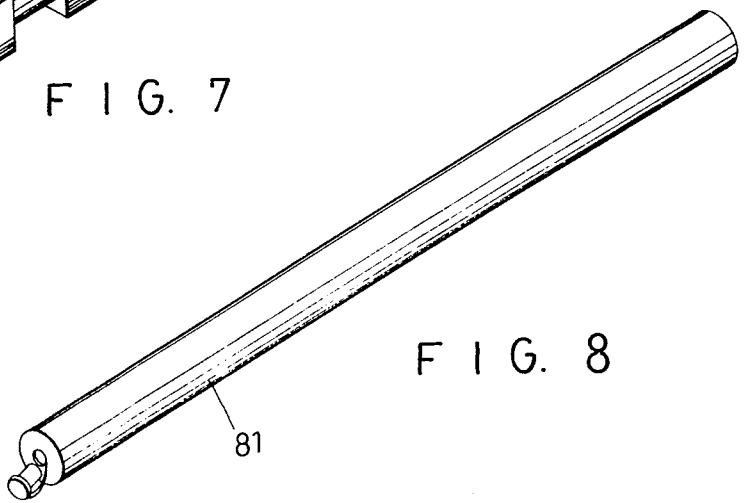
FIG. 8 is a perspective view of the third inflatable member design according to this invention.

The embodiments of the inflatable member shown in FIG. 7 and FIG. 8 are different in shape from the embodiment shown in FIGS. 5, 6. FIG. 7 illustrates an inflatable member 75 includes sections 78, 79 of square cross-section and circular cross-section arranged alternatively. FIG. 8 illustrates an inflatable column 81 having uniform cross-section.

Before being inflated, the inflatable member should be passed through the circular member 21 of the block of each design and disposed in the normally held position, so that, the inflatable member 70, after being inflated, will expand to tightly engage to the circular member 21.

Figure 12:
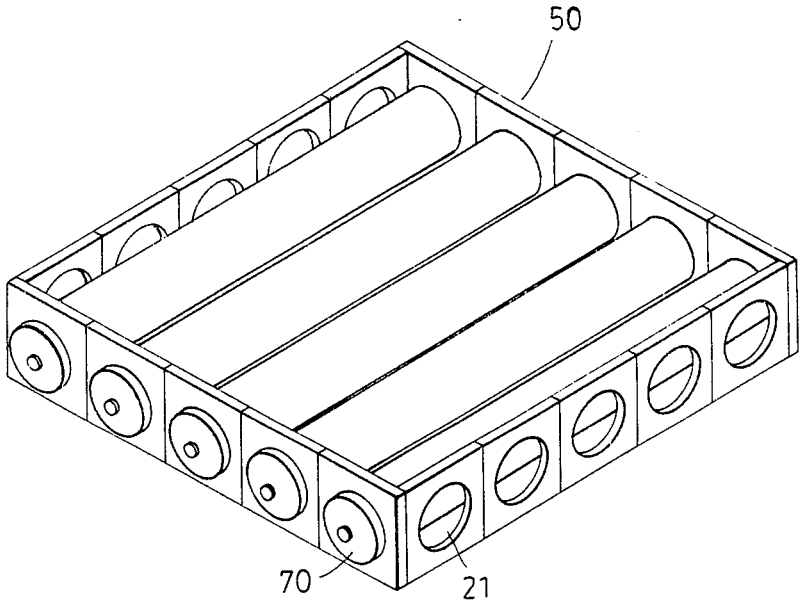
FIG. 12 is a perspective view of a finished article through the assembling of the blocks and inflatable members.
Figure 13:
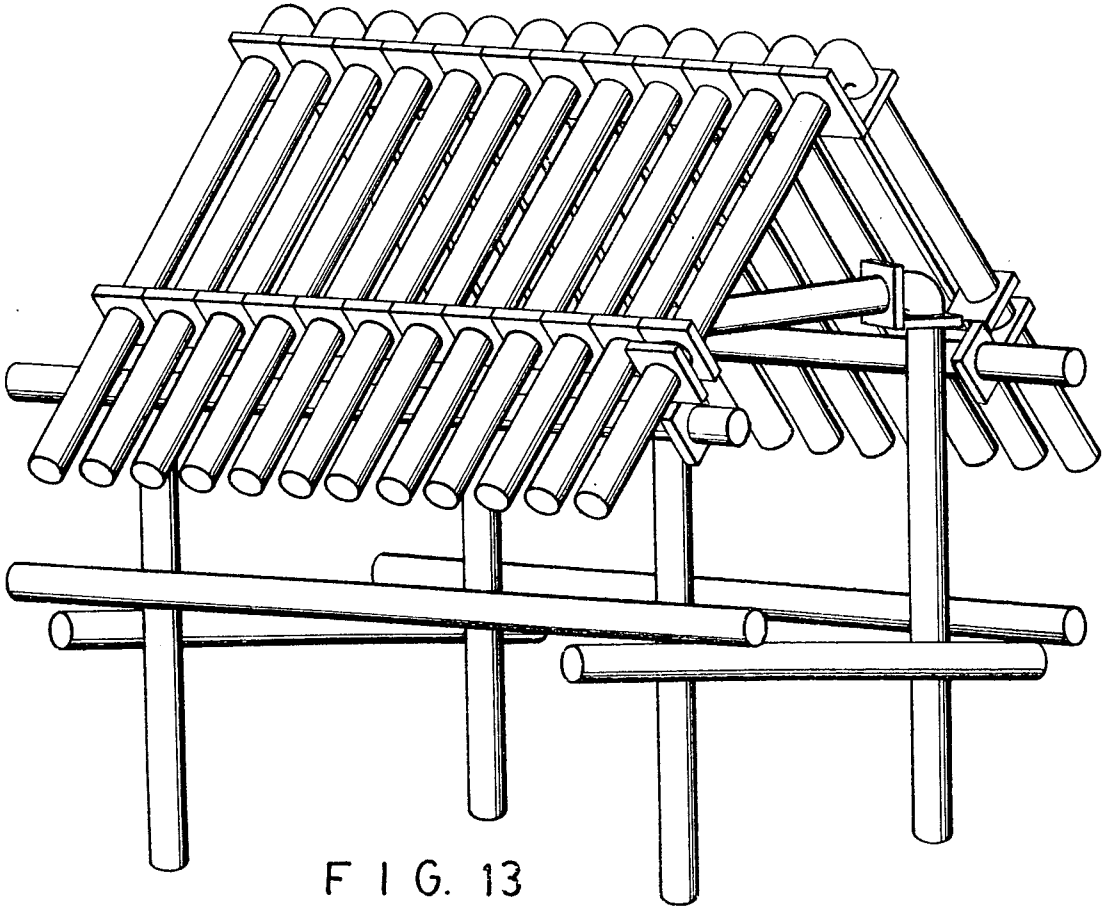
FIG. 13 is a perspective view of another finished article through assembling of the blocks and inflatable members.
Figure 14:
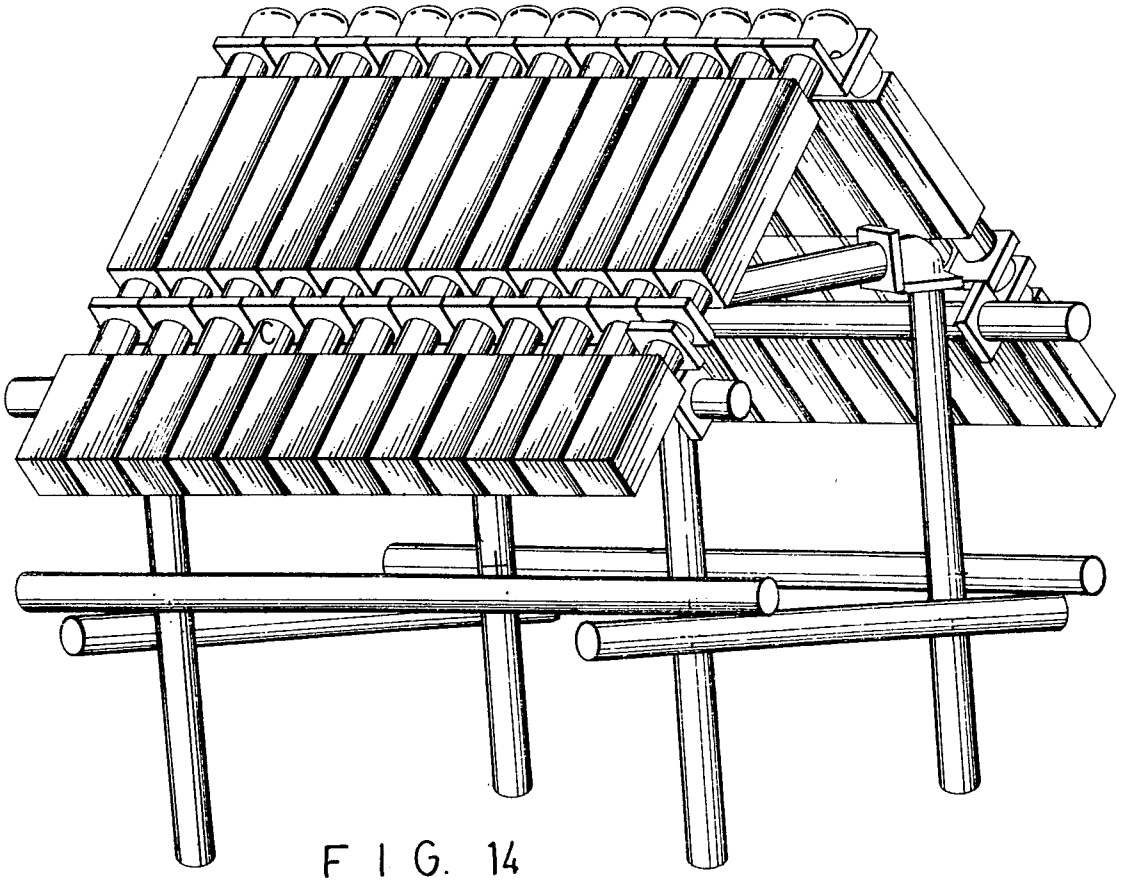
FIG. 14 is a perspective view of a further finished article through the assembling of the blocks and inflatable members.

The samples of finished articles of the building blocks disclosed in this invention are shown in FIG. 12, FIG. 13, and FIG. 14. In FIG. 12 the inflatable square article is completed by horizontal connection and vertical connection, respectively along the sides and at the corners and, the inflatable members 70 are arranged parallel with each other between two sides of the square article.

A house-like finished work is shown in FIG. 13. The horizontal connection is applied to the construction of the rafter roof, and the vertical connection is applied to the construction of the ridge board, and the inflatable member as shown in FIG. 8 is used to complete the roof. The difference between the finished works shown in FIG. 13 and FIG. 14 is that the inflatable members adopted in the latter are ones having the design as shown in FIG. 7.

While the invention has been described in connection with what is presently considered to be the most practical and preferred embodiments, it is to be understood that the invention, is not to be limited to the disclosed embodiment, but on the contrary, is intended to cover various modifications and equivalent arrangements included within the spirit and scope of the appended claims the scope of which is to be accorded the broadest interpretation so as to encompass all such modifications and equivalent structures.

I claim:

1. A toy building block adapted to be assembled to develop a desired shape through connecting a number of like blocks, said block comprising:

a frame with straight sides, having a plurality of connecting elements projecting from at least one side thereof, each of said connecting elements having two side walls contiguous with said frame and a front wall extending between said side walls, said side walls having slots adjacent said frame;

a plurality of sockets provided on another side of said frame for receiving said connecting elements of a horizontally or vertically adjoining block, said sockets each having inversely complimentary slots which interlock with said connecting element side wall slots to secure said block with a horizontally adjoining block;

a means for interlocking with another block in a crossed, edgewise intersecting fashion, said interlocking means located between two adjacent sockets, and a space between two adjacent connecting elements being dimensioned to snap-fit around said interlocking means of a crossed, edge-wise intersecting adjoining block;

and an elongated inflatable member for passing through said frame to enable a plurality of blocks to be connected and to increase the buoyancy of said blocks.

2. A toy building block as claimed in claim 1, wherein said frame has a polygonal outline.

3. A toy building block as claimed in claim 1, wherein said frame has a polygonal outline and an inscribed circular passage through it.

4. A toy building block as claimed in claim 3, wherein said inflatable member passes through said circular passages of a plurality of blocks and is inflatable to tightly engage with said circular passages.

5. A toy building block as claimed in claim 1, wherein said interlocking means is centrally positioned along said frame side, said interlocking means having a square cross-section.

6. A toy building block as claimed in claim 2, wherein said space is centrally positioned along said frame side.

7. A toy building block as claimed in claim 1, wherein the side walls of connecting elements on either side of said space have adjacent side walls which are spaced apart so that walls forming said sockets which protrude from the frame will interlock between the spaced connecting element side walls when two blocks are vertically or horizontally connected.

* * * * *